US005245795A

United States Patent [19]

Poché et al.

[11] Patent Number: 5,245,795

[45] Date of Patent: Sep. 21, 1993

[54] PIPE SUPPORT APPARATUS

[76] Inventors: Leo Poché, 5471 Oro Bangor Hwy., Oroville, Calif. 95966; James O. Gosney, 4340 Rose La., Concord, Calif. 94518

[21] Appl. No.: 801,398

[22] Filed: Dec. 2, 1991

[51] Int. Cl.[5] ..... B24B 5/40; B24B 41/06

[52] U.S. Cl. ..... 51/217 R; 269/287; 51/181 NT; 51/227 R; 7/163; 7/157

[58] Field of Search ..... 51/227 R, 181 R, 181 NT, 51/217 R; 269/95, 97, 88, 287, 248, 289 R; 7/100, 167, 164, 163, 157, 158; 29/560.1

[56] References Cited

U.S. PATENT DOCUMENTS

| | | | |
|---|---|---|---|
| 1,413,798 | 4/1922 | Shinn | 7/164 |
| 4,119,305 | 10/1978 | Anderson | 269/97 |
| 5,040,256 | 8/1991 | Mills | 51/181 R |
| 5,084,970 | 2/1992 | Garanhel | 7/163 |
| 5,165,673 | 11/1992 | Newton, Jr. | 269/97 |

FOREIGN PATENT DOCUMENTS

| | | | |
|---|---|---|---|
| 2085766 | 5/1982 | United Kingdom | 269/97 |

*Primary Examiner*—Robert A. Rose
*Attorney, Agent, or Firm*—Leon Gilden

[57] ABSTRACT

Spaced, parallel mounting plates include a first clamp rod orthogonally directed through a lower end of the clamp plates, with a guide pipe orthogonally directed through the mounting plates spaced from the first clamp rod. A second clamp rod is orthogonally directed through the pipe below the clamp plates to permit securement of a pipe or extension member mounted within the guide pipe, wherein the first clamp rod secures the organization to a support platform. A modification of the invention includes a measuring member mounted to a top surface of the upper clamp plate, with a plurality of abrasive conical bosses mounted to the top surface of the upper clamp plate for finished abrading of end portions of pipes mounted relative to the apparatus.

5 Claims, 4 Drawing Sheets

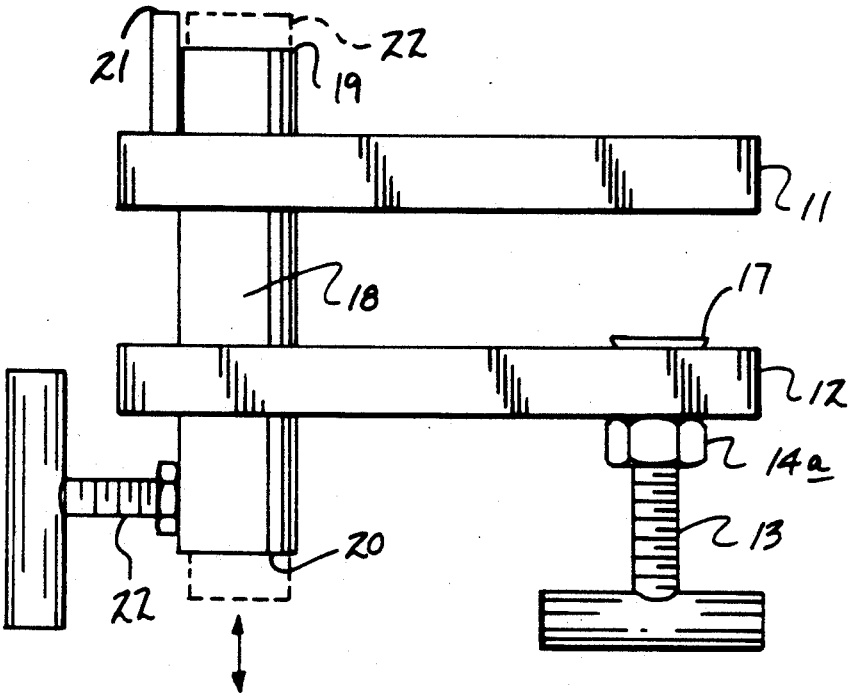
Fig 3
Fig 4
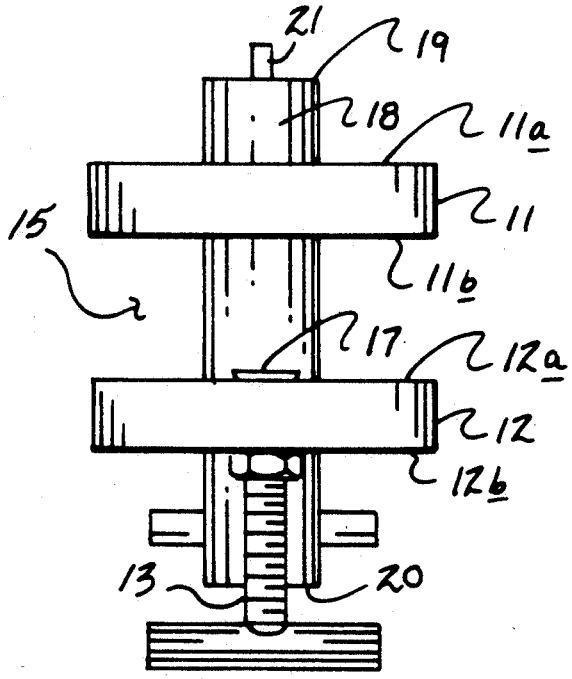

PIPE SUPPORT APPARATUS

BACKGROUND OF THE INVENTION

1. Field of the Invention

The field of invention relates to support apparatus, and more particularly pertains to a new and improved pipe support apparatus wherein the same is directed to clamp pipe members for various machining and welding procedures.

2. Description of the Prior Art

The clamping of pipe relative to machine procedures requires a proper clamping structure. The instant invention sets forth a portable structure to permit the operative working of pipe members relative to a convenient support surface permitting the organization to adaptability and ease of portability in use.

Prior art structure directed to the clamping of pipe is exemplified in U.S. Pat. No. 4,367,857 to McCarthy wherein a pipe bracket is arranged to mount a pipe relative to a sealing procedure to the pipe.

U.S. Pat. No. 4,915,125 to Lester sets forth a valve stem extension assembly for clamping to a cylindrical stem portion of a valve member.

U.S. Pat. No. 4,793,578 to Howard sets forth a multiple conduit support system where a plurality of cylindrical clamps are arranged to permit securement to various conduit pipe.

U.S. Pat. No. 4,059,872 to Delesandri sets forth a hose clamp assembly for securement of a hydraulic hose relative to a rigid adjacent pipe member.

As such, it may be appreciated that there continues to be a need for a new and improved pipe support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of pipe clamping apparatus now present in the prior art, the present invention provides a pipe support apparatus wherein the same is arranged (or positioning and clamping of pipe relative to a working procedure. As such, the general purpose of the present invention, which will be described subsequently in greater detail, is to provide a new and improved pipe support apparatus which has all the advantages of the prior art pipe support apparatus and none of the disadvantages.

To attain this, the present invention provides spaced, parallel mounting plates including a first clamp rod orthogonally directed through a lower end of the clamp plates, with a guide pipe orthogonally directed through the mounting plates spaced from the first clamp rod. A second clamp rod is orthogonally directed through the pipe below the clamp plates to permit securement of a pipe or extension member mounted within the guide pipe, wherein the first clamp rod secures the organization to a support platform. A modification of the invention includes a measuring member mounted to a top surface of the upper clamp plate, with a plurality of abrasive conical bosses mounted to the top surface of the upper clamp plate for finished abrading of end portions of pipes mounted relative to the apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pipe support apparatus which has all the advantages of the prior art pipe support apparatus and none of the disadvantages.

It is another object of the present invention to provide a new and improved pipe support apparatus which may be easily and efficiently manufactured and marketed.

It is a further object of the present invention to provide a new and improved pipe support apparatus which is of a durable and reliable construction.

An even further object of the present invention is to provide a new and improved pipe support apparatus which is susceptible of a low cost of manufacture with regard to both materials and labor, and which accordingly is then susceptible of low prices of sale to the consuming public, thereby making such pipe support apparatus economically available to the buying public.

Still yet another object of the present invention is to provide a new and improved pipe support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view of the instant invention.

FIG. 4 is an orthographic end view of the instant invention.

DESCRIPTION OF THE PREFERRED EMBODIMENT

Figure 1:
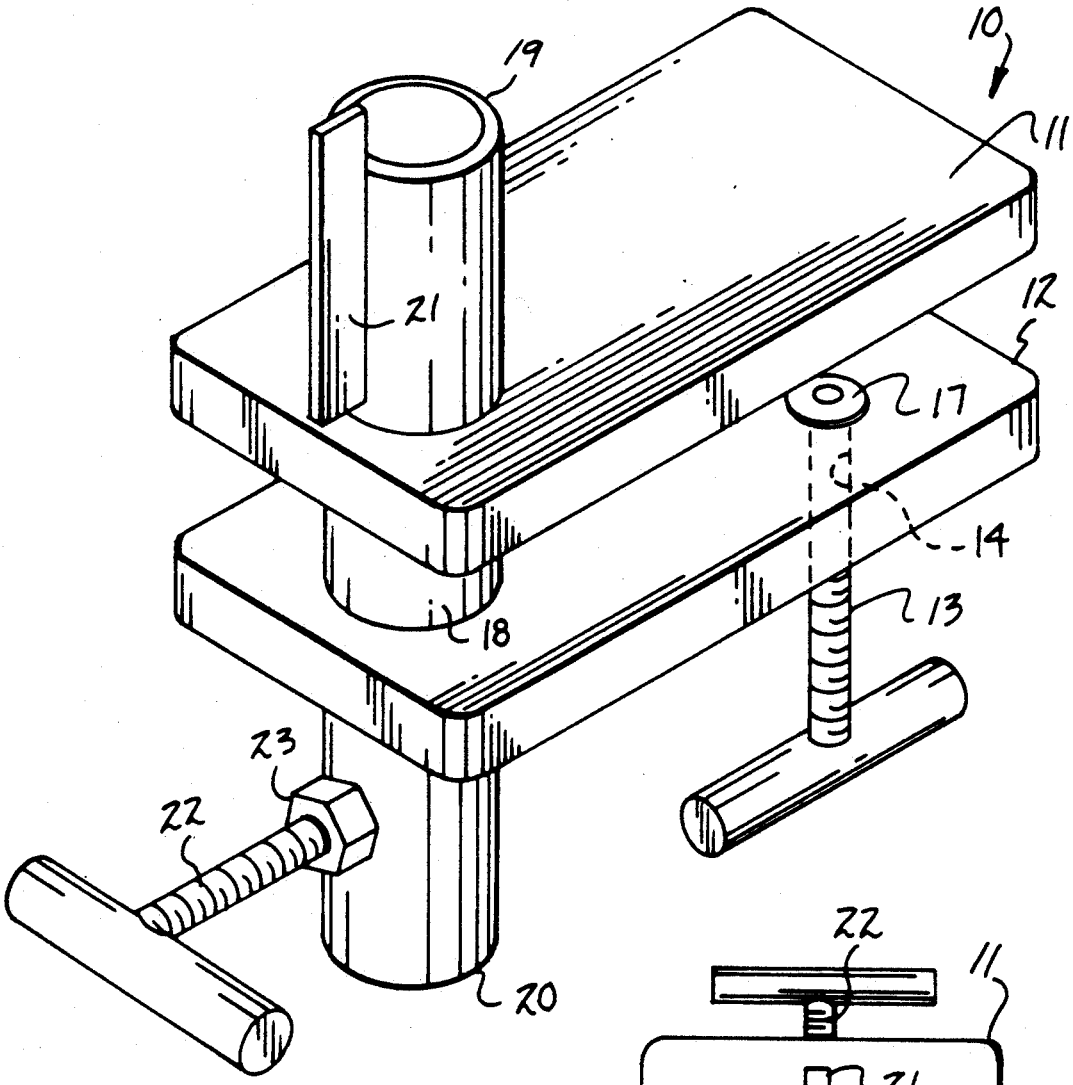
FIG. 1 is an isometric illustration of the instant invention.
Figure 2:
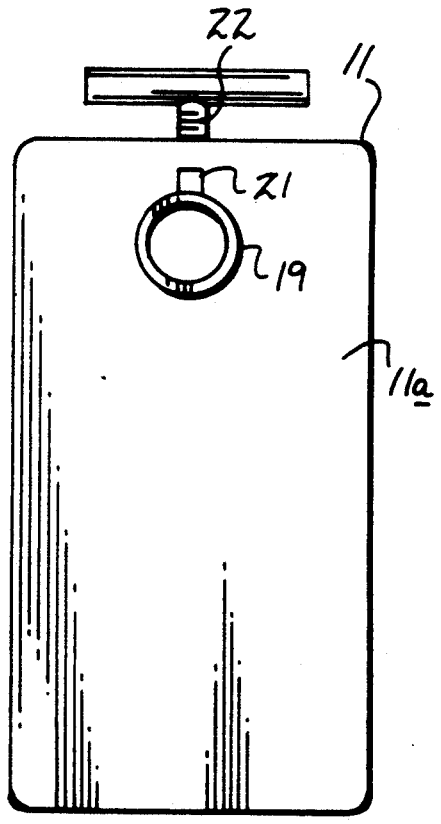
FIG. 2 is an orthographic top view of the instant invention.
Figure 5:
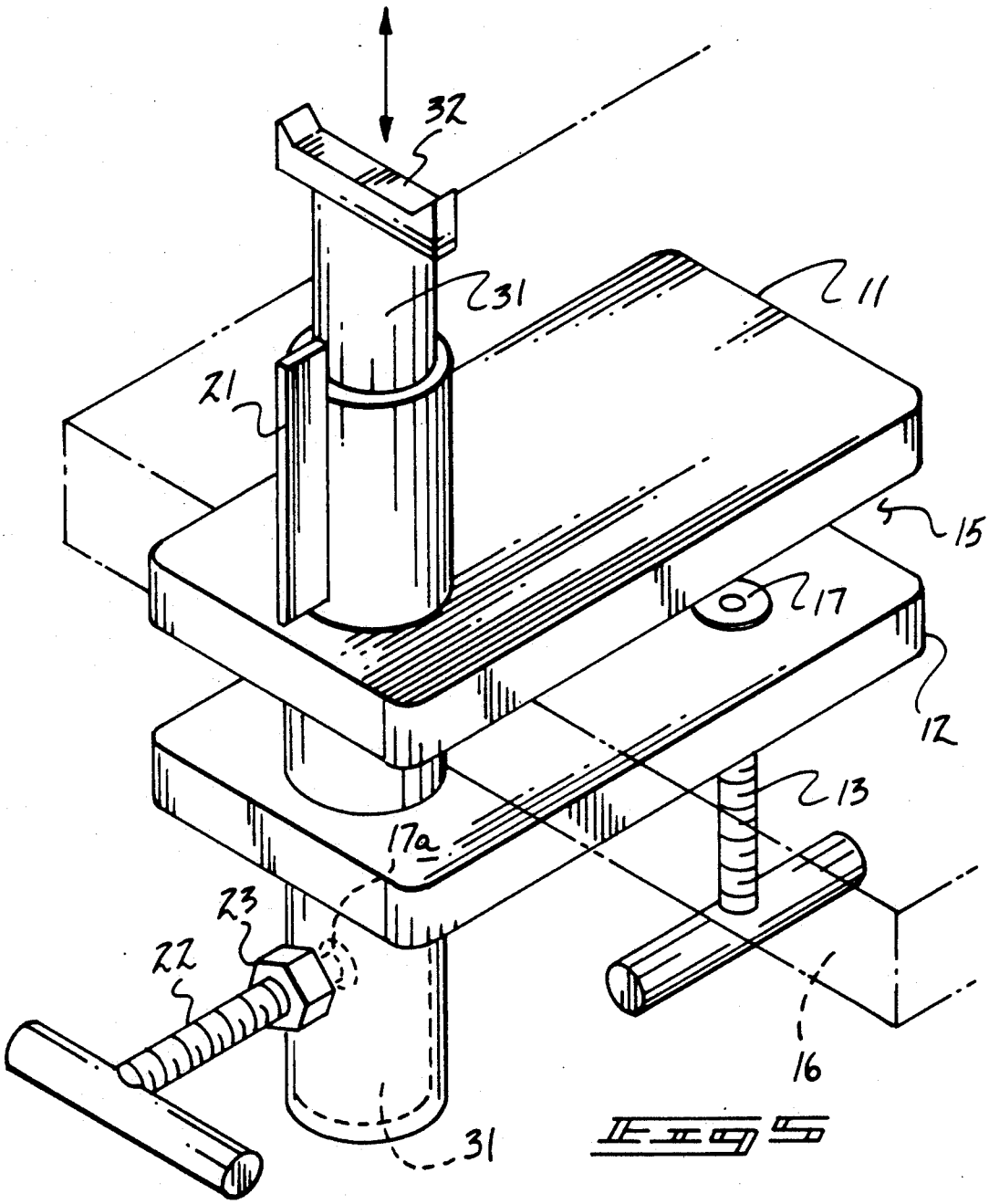
FIG. 5 is an isometric illustration of the invention utilizing a positioning leg relative to the guide pipe.

With reference now to the drawings, and in particular to FIGS. 1 to 9 thereof, a new and improved pipe support apparatus embodying the principles and concepts of the present invention and generally designated by the reference numerals 10, 10*a*, and 10*b* will be described.

More specifically, the pipe support apparatus 10 of the instant invention essentially comprises a first mounting plate 11 spaced from a second mounting plate 12 The first mounting plate 11 includes a first planar top face 11*a* spaced from and parallel a first planar bottom face 11*b*. The second mounting plate 12 includes a second mounting plate top face 12*a* and a second planar bottom face 12*b*. It should be noted the faces are arranged in a parallel coextensive relationship relative to one another. An externally threaded first clamp rod 13 is orthogonally directed through the second mounting plate projecting into a plate gap 15 oriented between the bottom face 11*b* and the top face 12*a* of the first and second plates 11 and 12 respectively. The first clamp rod 13 is directed through a second plate bore 14 orthogonally oriented relative to the top and bottom faces 12*a* and 12*b* and threadedly received within an internally threaded guide member 14*a* (see FIG. 4). In use, the plate gap 15 receives a support platform 16 therewithin (see FIG. 5), with the first clamp rod 13 directed towards the support platform 16, wherein a first clamp plate 17 orthogonally mounted to the clamp rod 13 engages the support platform 16 for securement of the apparatus thereto.

A guide pipe 18 is fixedly and orthogonally directed between the first and second plates 11 and 12 and extends above the top face 11*a* terminating in a guide pipe upper end 19 and extends below the second planar bottom face 12*b* terminating in a lower end 20. An alignment flange 21 is fixedly mounted to an exterior surface of the guide pipe 18 above the top face 11*a* and the alignment flange 21 arranged parallel to an axis defined by the guide pipe 18 and orthogonally oriented relative to a diameter of the guide pipe 18 projecting above the upper end 19 for visual alignment of a workpiece pipe member 24 (see FIG. 3) projecting thereabove to provide visual alignment of the workpiece relative to various machine, grinding, and welding procedures. An externally threaded second clamp rod 22 orthogonally directed into the guide pipe 18 relative to its axis is positioned below the second plate 12 and includes a second clamp plate 17*a* to secure a workpiece pipe 24, or alternatively a cylindrical positioning leg 31 (see FIG. 5). The cylindrical positioning leg 31 defining part of the apparatus is slidably received in a complementary manner within the guide pipe 18 and includes a "U" shaped mounting cradle 32 fixedly mounted at an upper terminal end thereof for positioning of a pipe thereon when horizontal alignment of the pipe relative to the support platform 16 is desired.

Figure 6:
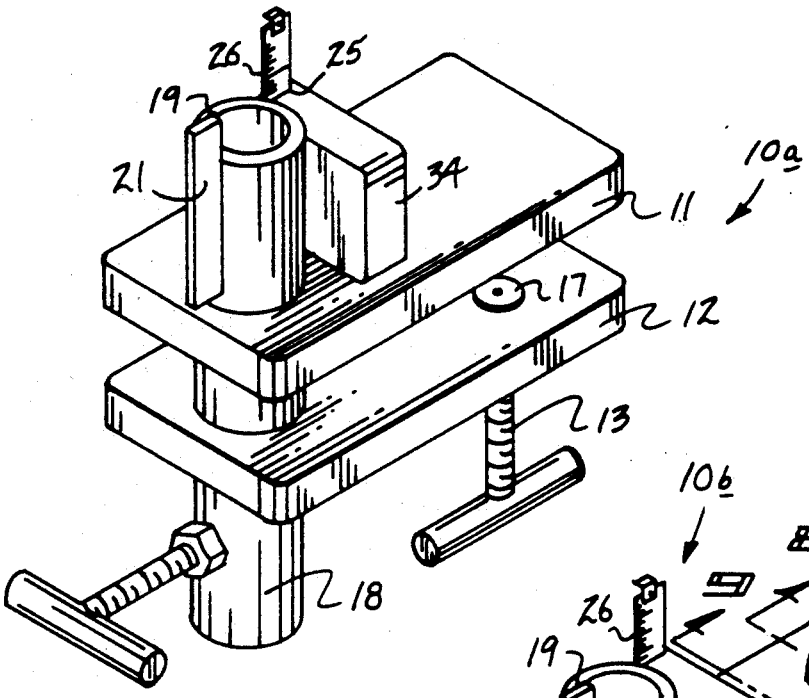
FIG. 6 is an isometric illustration of a modified aspect of the invention.
Figure 7:
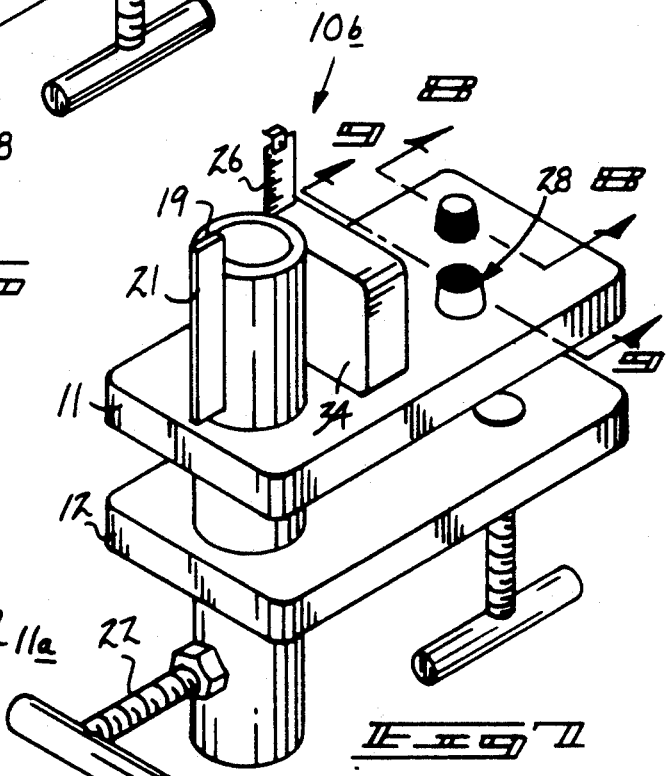
FIG. 7 is an isometric illustration of a further modified aspect of the invention.
Figure 8:
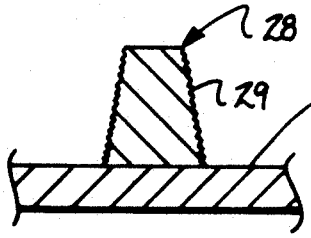
FIG. 8 is an orthographic view, taken along the lines 8—8 of FIG. 7 in the direction indicated by the arrows.
Figure 9:
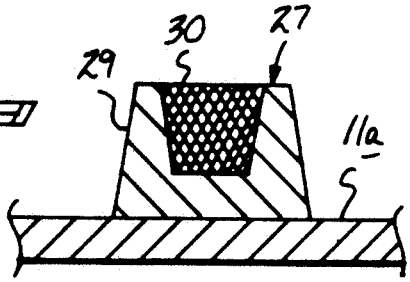
FIG. 9 is an orthographic view, taken along the lines 9—9 of FIG. 7 in the direction indicated by the arrows.

Reference to FIGS. 6 and 7 illustrate the use of a graduated tape measure housing 31 mounted to the top face 11*a* of the first plate 11, including a slot 25 positioned adjacent the upper end 19 permitting extension of a graduated tape measure 26 oriented generally parallel to the axis of the guide pipe 18 extensible and retractable relative to the tape measure housing 34. In this manner, proper projection of the aforenoted workpiece pipe 24 of FIG. 3 is provided when mounted within the guide pipe 18, as well as the positioning leg 31 and its orientation relative to the upper end 19 of the guide pipe 18.

Further, the apparatus 10*b*, in contrast to the apparatus 10*a* of FIG. 6, utilizes a respective first and second abrasive conical boss 27 and 28 mounted to the first planar top face 11*a*. The first boss 27 includes an abrasive external conical surface 29, while the second boss 28 includes an abrasive internal conical surface 30 defining a cavity within the second boss 28 to provide finishing of an external or internal end portion of a pipe member 24 subsequent to a machining, cutting, or welding procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pipe support apparatus, comprising, a first mounting plate spaced from, parallel to, and coextensive with a second mounting plate, with the first mounting plate positioned above the second mounting plate, and a plate gap defined between the first mounting plate and the second mounting plate for reception of a support platform therebetween, and a first clamp rod orthogonally directed through the second mounting plate extending into the plate gap arranged for securement of the support platform within the plate gap, and a guide pipe orthogonally and fixedly mounted extending through the first mounting plate and the second mounting plate, with the guide pipe including a guide pipe upper and extending above the first mounting plate, and a guide pipe lower end extending below the second mounting plate, and the guide pipe includes an alignment flange fixedly mounted to the guide pipe extending from a first position adjacent the first mounting plate to a second position spaced above the guide pipe upper end, with the alignment flange arranged parallel to an axis defined by the guide pipe and oriented orthogonally relative to a diameter defined by the guide pipe, and a second clamp rod orthogonally directed through the guide pipe relative to the axis below the second plate for clamping of a workpiece therewithin.

2. An apparatus as set forth in claim 1 including a cylindrical positioning leg slidably received within the guide pipe, wherein the positioning leg is cooperative with the second clamp rod for securement of the cylindrical positioning leg within the guide pipe, and the cylindrical positioning leg including a "U" shaped mounting cradle fixedly and orthogonally mounted to an upper terminal end of the cylindrical positioning leg for positioning of a workpiece thereon.

3. An apparatus as set forth in claim 2 wherein the first clamp rod and the second clamp rod include a respective first clamp rod plate and a second clamp rod plate orthogonally mounted to the respective first clamp rod and the second clamp rod within the plate gap and the guide pipe respectively.

4. An apparatus as set forth in claim 3 including a tape measure housing fixedly mounted to a top surface of a first mounting plate adjacent the guide pipe, wherein the tape measure housing includes a housing slot, the housing slot positioned adjacent the guide pipe upper end, and a graduated tape measure oriented parallel relative to the axis of the guide pipe extensible and retractable within the housing for projection above the guide pipe upper end.

5. An apparatus as set forth in claim 4 including a first abrading conical boss and a second abrading conical boss mounted to the top surface of the first mounting plate spaced from the tape measure housing, wherein the first abrading conical boss includes an abrasive external conical surface, and the second abrading conical boss includes an abrasive internal conical surface defining a cavity within the second conical boss, wherein the first conical boss permits abrading of an interior end surface of a pipe member, and wherein the second conical boss permits abrading of an external end portion of a workpiece pipe member.

* * * * *